US005520726A

United States Patent [19]

Schwabe et al.

[11] Patent Number: 5,520,726

[45] Date of Patent: May 28, 1996

[54] CASTING INVESTMENT COMPOUNDS

[75] Inventors: Peter Schwabe, Leverkusen; Martin Grunwald, Pulheim; Lothar Puppe, Burscheid, all of Germany

[73] Assignee: Bayer Aktiengesellschaft, Leverkusen, Germany

[21] Appl. No.: 252,868

[22] Filed: Jun. 2, 1994

[30] Foreign Application Priority Data

Jun. 9, 1993 [DE] Germany ..... 43 19 187.8

[51] Int. Cl.[6] ..... B22C 1/00

[52] U.S. Cl. ..... 106/38.9

[58] Field of Search ..... 106/38.9; 164/523, 164/529

[56] References Cited

U.S. PATENT DOCUMENTS

| | | | |
|---|---|---|---|
| 3,854,961 | 12/1974 | Flasch . | |
| 4,383,861 | 5/1983 | Seeney et al. | 106/38.9 |
| 4,390,370 | 6/1983 | Seeney et al. | 106/38.9 |
| 4,422,496 | 12/1983 | Seeney et al. | 164/528 |
| 4,445,565 | 5/1984 | Seeney et al. | 106/38.9 |
| 4,464,492 | 8/1984 | Kraemer | 106/38.2 |
| 4,522,651 | 6/1985 | Seeney et al. | 106/38.9 |
| 4,626,466 | 12/1986 | Schmidt et al. | 106/38.27 |
| 5,372,179 | 12/1994 | Sakakibara et al. | 164/349 |
| 5,417,751 | 5/1995 | Twardowski et al. | 106/38.3 |

FOREIGN PATENT DOCUMENTS

| | | | |
|---|---|---|---|
| 417527 | 8/1990 | European Pat. Off. . | |
| 0006746 | 1/1983 | Japan | 164/529 |

OTHER PUBLICATIONS

Derwent Abstract, AN 78–38952A 124, Apr. 17, 1978.

D. W. Breck, "Zeolite Molecular Sieves, Structure, Chemistry and Use", J. Wiley & Sons, New York, 1974 (No Month).

K. Eichner, Zahnarztl. Werkstoffe und ihre Verarbeitung, Bd. 1, Huthig Verlag, Heidelber, 1981, S. 42; (No Month).

Quintessenz Zahntechnik 17, 73–86 (1991) (No Month).

Derwent Publications Ltd., London, G.B., AN 90–057820 Aug. 23, 1989.

*Primary Examiner*—Karl Group
*Assistant Examiner*—David Sample
*Attorney, Agent, or Firm*—Sprung Horn Kramer & Woods

[57] ABSTRACT

The present invention relates to investment compounds containing zeolites and to models and moulds made from these. The investment compounds according to the invention are used in metal casting, preferably in the preparation of precision castings.

8 Claims, No Drawings

CASTING INVESTMENT COMPOUNDS

The present invention relates to investment compounds containing zeolites and to models and moulds made from these. The investment compounds according to the invention are used in metal casting, preferably in the preparation of precision castings.

In the preparation of metal castings, the important point in many cases is as identical as possible a reproduction of details, such as fine surface structures. Particularly in cases, in which the original is not available for an unlimited time, a cast, for example a silicone cast, is then first made, with the aid of which a so-called master model, for example of plaster, is produced.

From the latter, another cast, in most cases of agar or silicone, is made, with the aid of which a copy of the master model of plaster or, if parts exactly fitting to the original are to be made, is produced from an investment compound.

In the latter case, in particular opposite the hydrophobic silicone surfaces, a formation of fine, salt-like crusts takes place on the surface of the model made from an investment compound, namely the so-called efflorescences. The attempt to remove these, for example mechanically, frequently causes damage which, like the efflorescences which have not been removed, is itself the cause of defects on the cast object produced later.

It was the object underlying the present invention to produce casting investment compounds which are free of efflorescences but possess unchanged good mechanical properties.

According to the invention, this object is achieved by the addition of zeolites to the investment compound compositions known per se. The investment compounds according to the invention are in general used in metal casting, for example in the restoration and copying of valuable metal objects. A preferred field of application of the investment compounds according to the invention is dental engineering, where tooth replacement parts are made with the aid of casting investment compounds. In this case, wax modellings, which reproduce the shape of the tooth restoration which is to be cast, are invested with the aid of such a compound, or investment compound models are produced, such as, for example, in the prepartion of model-casting structures for partial tooth prostheses. The wax modellings are heated together with the investment compounds and thus burn off without a residue. As a result, cavities are formed in which the dental restoration materials, as a rule metal alloys, are cast. After hardening and cooling of the restoration materials, the investment compounds are removed and the cast tooth replacement part is obtained which, after further working steps, such as blasting, polishing, veneering and the like, is available for incorporation into the denture. The investment compound compositions are known per se. They consist as a rule of a powder which is composed of refractory materials, such as, for example, quartz or cristobalite, and a binder, such as, for example, magnesium oxide/ammonium phosphate or calcium sulphate hemihydrate, and of a mixing fluid, such as, for example, water or a silica sol solution. Frequently, so-called phosphate-bonded investment compounds are used which essentially contain magnesium oxide and phosphates as binders and quartz and cristobalite as refractory materials. The mixing fluid used for this purpose is frequently a silica sol solution. The reactions during the solidification and heating of the mixed investment compound can be represented by the following equations:

Solidification: $NH_4H_2PO_4+MgO \rightarrow MgNH_4PO_4+H_2O$

Heating: $2MgNH_4PO_4 \rightarrow Mg_2P_2O_7+H_2O+2NH_3$

In various working techniques, for example, in the preparation of investment compound models for making model-casting structures or in the preparation of refractory individual stumps, casts of dental engineering models, which frequently consist of plaster as the model material, are sometimes made, and these are then filled with the investment compounds described above, the investment compound solidifying in this cast mass. This method is also known under the term "duplicating". Inter alia, aqueous agar compositions or else the increasingly used silicone duplicating materials, which give a very accurate reproduction true to shape, are known as duplicating materials. During the solidification reaction, after the completion thereof and the release of the resulting investment compound model from the silicone duplicating cast mass, the efflorescences, which have already been mentioned above and which are basically precipitations of crystalline alkali metal phosphates, frequently occur on the surface of the investment compound models.

The alkalis presumably originate mainly from the additives which are added for stabilization to the silica sol solutions used as mixing fluids, or they originate from the alkali metal phosphate additives which are added to the investment compound powder formulations for controlling the setting kinetics.

These so-called "efflorescences" can adversely affect the accuracy of the fit of the tooth replacement parts prepared on the basis of such investment compound models, so that it is necessary to avoid the "efflorescences".

There has been no lack of attempts at preventing these efflorescences. It is known that investment compound formulations with markedly changed setting kinetics and a lower setting temperature have been improved in this respect; however, these formulations cannot be used opposite agar-based duplicating gel, since adhesions of investment compound to the agar duplicating materials occur at the low setting temperatures. This means that these investment compound formulations can then no longer be universally used for duplicating materials of silicone and agar, so that the applicability is greatly restricted.

Another attempt at suppressing the "efflorescences" is described in EP-0,417,527. In this case, the addition of 0.01 to 10% by weight of at least one solid organic acid soluble in water and/or alcohol and having 2 to 10 carbon atoms is recommended in the preparation of casting moulds from casting investment compounds.

These organic compounds which are combustible at the usual preheating temperatures can lead to a weakening of the ceramic structure and effect an increase in the expansion on setting, which adversely affects the accuracy of the fit of the finished workpiece. Added quantities of the order of 1.2% by weight already effect a significant lowering of the setting temperature and a marked increase in the setting time, which prevent universal application for duplicating materials of silicone and agar gel.

An addition of 5.0% by mass of citric acid to an investment compound consisting of 42.0% by weight of quartz sand, 25.0% by weight of cristobalite powders, 9.1% by weight of magnesium oxide, 8.0% by weight of phosphates, 0.5% by weight of coloured pigments and 10.4% by weight of quartz powder gives a composition which, with a quantity of mixing fluid of 17 ml of silica sol solution per 100 g of powder, does not lead to any workable consistency, because of extremely slow hardening reaction and a very inhomogenous hardening.

It has been found that the object underlying the invention is achieved by the addition of zeolites to the investment compounds known per se.

The zeolites are preferably employed in quantities from 0.1 to 10.0% by weight (relative to the total pulverulent compound before the addition of the mixing fluid), particularly preferably in quantities from 0.4 to 5.0% by weight.

Zeolites to be employed preferably according to the invention are characterized by the general formula (I):

$M^1n[mM^2O_2 \times n\ SiO_2] \times qH_2O$ where:

$M^1$ denotes one equivalent of an exchangeable cation, whose number corresponds to the proportion of $M^2$, $M^2$ denotes a trivalent element which, together with the Si, forms the oxide skeleton of the zeolite, n/m denotes the $SiO_2/M^2O_2$ ratio and q denotes the quantity of the adsorbed water.

From their fundamental structure, zeolites are crystalline alumosilicates which are built up from a network of tetrahedra of $SiO_4$ and $M^2O_4$. The individual tetrahedra are mutually linked by oxygen bridges via the corners of the tetrahedra and form a spatial network which is evenly penetrated by channels and voids.

The individual zeolite structures differ by the arrangement and size of the channels and voids and by their composition. To balance the negative charge of the lattice, which arises from the proportion of $M^2$, exchangeable cations are incorporated. The adsorbed water phase $qH_2O$ is reversibly removable, without the skeleton losing its structure.

$M^2$ is in many cases aluminium, but it can also be partially or wholly substituted by other trivalent elements.

A detailed description of zeolites has been given, for example, in the monograph by D. W. Breck "Zeolite Molecular Sieves, Structure, Chemistry and Use", J. Wiley & Sons, New York, 1974.

For example the following zeolites are particularly suitable for the process according to the invention: faujasites, mordenites, zeolite A, zeolite β, zeolite Ω, zeolite L, offretite, ZSM 12, pentasils, PSH-3, ZSM 22, ZSM 23, ZSM 48, EU-1, zeolite T, chabasites, gmelinites, ferrierites, zeolite rho, ZK-5 and others.

The zeolites suitable for the process according to the invention can contain alkali metal cations, such as, for example, Li, Na, K or Rb, or alkaline earth metal cations, such as, for example, Mg, Ca or Sr, or else other cations, such as, for example, H, $NH_4$, Zn, Cu, Ni, Co, Mn, rare earth metals and others. Mixed forms can also be used.

In a particularly preferred embodiment, the zeolites used according to the invention are those in which at least a part of the metal cations has been exchanged for hydrogen ions, preferably 50 to 100%, particularly preferably 80 to 100% of all the exchangeable metal cations originally present.

Particularly preferred for the process according to the invention are zeolites having a multiplicity of acidic centres, such as are formed, for example, by treating zeolites of the faujasite structure with ammonium salt solutions or rare earth salt solutions and subsequent thermal treatment. The added quantity of the zeolites described above is preferably a quantity from 0.1 to 10% by weight. The efflorescence-preventing effect of various zeolite types is pronounced to different extents. Simple experiments allow optimum dosage. The zeolites containing alkali metal, alkaline earth metal or rare earth metal are very effective. The most effective zeolites are those of the H-zeolite Y-type.

For H-zeolite Y, 0.3 to 1.5% by weight was found to be a particularly preferred quantity for obtaining the efflorescence-preventing effect and, for the zeolites containing a rare earth metal, the particularly preferred added quantity is 0.7 to 2.0% by weight.

The basic formulations of the investment compound powders according to the invention can be prepared in a conventional manner known per se in a suitable mixing unit, for example a Nauta mixer, Lödige mixer or the like, in which the pulverulent additives including the zeolites are mixed together one after the other. It is also possible, however, to prepare master mixtures which contain the zeolite, and to mix in these master mixtures. Furthermore, it is also possible with the zeolite-containing investment compound formulations according to the invention, which have been described, to spray these in a manner known per se with isoparaffins, without losing the desired properties described above, for example in order to improve their flow properties once again.

In terms of application, the zeolite-containing investment compound powder mixtures according to the invention show no disadvantages as compared with investment compound mixtures not containing zeolite. No changes in the setting time and setting temperature, relevant to processing, occur. The good gel compatibility is unchanged. The good mechanical strength of the casting muffle or of the model made from the investment compound is unchanged, and the same applies to the expansion on setting, which is an important parameter for the degree of the dimensional accuracy of the casting obtained later.

The investment compound formulations according to the invention can be used, in particular, both opposite duplicating silicone and opposite an agar duplicating composition.

However, the efflorescences described above do not arise when the investment compounds according to the invention are used, so that considerably more precise castings are obtained with the aid of them.

The examples which follow explain the invention.

The expansion on setting, the processing time and the compressive strength are determined analogously to DIN 13919, part 2, June 1984. The setting time is the point in time at which the setting temperature reaches the temperature maximum. The tendency to efflorescence was tested by mixing the investment compound powders described with a commercially available silica sol mixing fluid (Levotherm mixing fluid) and pouring the mixed casting investment compound paste into an addition-crosslinked silicone duplicating moulding compound (for example of Tecnovil commercial material), by releasing the solidified investment compound model and assessing the investment compound surface 24 hours after mould release and standing in room air. The investment compound powder composition is prepared by homogeneous mixing of the individual components in a slow-blade mixer (Lödige mixer), a conical truncated cone mixer with revolving screw (Nauta mixer) or in tumble mixers, but other suitable mixer units can in principle also be used. The examples given below are intended to describe the invention, without restricting it by the description of these examples.

The constituents of phosphate-bonded casting investment compounds are described, for example, in K. Eichner, Zahn ärztliche Werkstoffe und ihre Verarbeitung [Dental Materials and their Processing], volume 1, Hüthig Verlag, Heidelberg, 1981, page 42, or, for example, in: Quintessenz Zahntechnik 17, 73–86 (1991).

The quartz powder used in the examples has an $SiO_2$ content of >99% with a total residue of about 90% by volume at a grain diameter of 2 μm, measured by means of a Cilas granulometer, and a total residue of about 89% by weight at a sinking velocity-equivalent diameter of 2.5 μm, measured by sedimentation analysis by means of a Sedi Graph 5100. A usable type of quartz sand has an $SiO_2$ content of >99% at a mean grain size of 0.28 mm. A cristobalite powder type which can be used shows, at an $SiO_2$ content of >99%, a grain size distribution by screen analysis of (diameter/proportion in % by weight) >200 μm/0.5, >100/5, >63/20, >40/44, <40/30.5 and a BET surface area of 0.9 $m^2/g$. The phosphates used are Fabutit 746 (made by Budenheim) in a addition to a little Fabutit GI/66A (made by Budenheim), and the magnesium oxide used is Dynamag K (made by Hüls) in addition to a little Mag Chem 40 (Göbel & Pfrengle). For colouring the compound, a red dyestuff (made by Conrads) was used, which on average has the following composition: 53.9–51.6% of $SiO_2$, 24.0–27.4% of $Al_2O_3$, 6.3–11.6% of $Fe_2O_3$ and 0.8–0.21% of MgO, loss on ignition 12.5–8.5%.

EXAMPLE 1

Various investment compounds mixed with silica sol solution were assessed, after solidification in the silicone mould, for their efflorescence behaviour opposite duplicating silicone (SE=rare earth metal):

| | 1 | 2 | 3 | 4 | 5 |
|---|---|---|---|---|---|
| Composition of the investment compound powders [% by weight] | 40.0 quartz sand<br>25.0 cristobalite<br>9.4 magnesium oxide<br>8.0 phosphates<br>17.6 quartz powder<br>(comparison mixture) | 40.0 quartz sand<br>25.0 cristobalite<br>9.4 magnesium oxide<br>8.0 phosphates<br>17.1 quartz powder<br>0.5 H-zeolite Y | 40.0 quartz sand<br>25.0 cristobalite<br>9.4 magnesium oxide<br>8.0 phosphates<br>16.6 quartz powder<br>1.0 H-zeolite Y | 42.0 quartz sand<br>25.0 cristobalite<br>9.4 magnesium oxide<br>8.0 phosphates<br>0.5 dyestuff<br>13.1 quartz powders<br>2.0 H-zeolite | 42.0 quartz sand<br>25.0-cristobalite<br>9.1 magnesium oxide<br>8.0 phosphates<br>14.4 quartz powder<br>1.0 H-zeolite Y<br>0.5 dyestuff Y |
| Efflorescences | yes | no | no | no | no |

| | 6 | 7 | 8 | 9 |
|---|---|---|---|---|
| Compo,-sition of the investment compound powders [% by weight] | 42.0 quartz sand<br>25.0 cristobalite<br>9.1 magnesium oxide<br>8.0 phosphates<br>0.5 dyestuff<br>12.9 quartz powder<br>1.0 H-zeolite Y<br>1.5 isoeicosane | 42.0 quartz sand<br>25.0 cristobalite<br>9.1 magnesium oxide<br>8.0 phosphates<br>0.5 dyestuff<br>15.4 quartz powder<br>(comparison mixture) | 42.0 quartz sand<br>25.0 cristobalite<br>9.1 magnesium oxide<br>8.0 phosphates<br>0.5 dyestuff<br>14.4 quartz powder<br>0.5 SE-zeolite Y<br>0.5 NaCl | 42.0 quartz sand<br>25.0 cristobalite<br>9.1 magnesium oxide<br>8.0 phosphates<br>0.5 dyestuff<br>14.2 quartz powder<br>1.2 SE-zeolite Y |
| Efflorescences | no | yes | no | no |

The tests also show that an addition of isoparaffin does not impede the efflorescence-preventing properties of the addition of zeolites.

| Composition of the investment compound | S | S + 1.5 parts by weight of H-zeolite Y | S + 1.5 parts by weight of K/Na zeolite A | S + 1.5 parts by weight of K-zeolite L | S + 2 parts by weight of Ca-zeolite Y | S + 3 parts by weight of K-zeolite Y |
|---|---|---|---|---|---|---|
| Degree of the efflorescences*) | 5 | 1 | 1–2 | 2–3 | 1 | 2 |

*)5 = pronounced efflorescences
4 = moderate efflorescences on the front and/or rear of the model
3 = slight efflorescences on the front and/or rear of the model
2 = very slight efflorescences, mainly on the rear of the model
1 = no efflorescences

EXAMPLE 2

In the experiments of this example, a standard investment compound mixture (=S) having the following composition is used.

S: 42.0 parts by weight of quartz sand 25.0 parts by weight of cristobalite powder 9.1 parts by weigh of magnesium oxide 8.0 parts by weight of phosphates 15.9 parts by weight of quartz powder The addition, according to the invention, of zeolites to the investment compound powder shows extensive improvements in the tendency not to efflorescence in all cases, as compared with the mixture S.

EXAMPLE 3

| Physical data of invesitment compound samples | | | |
|---|---|---|---|
| Composition of the investment compound powders [% by mass] | 42.0 quartz sand<br>25.0 cristobalite powder<br>9.1 magnesium oxide<br>8.0 phosphates<br>0.5 dyestuff<br>15.4 quartz powder (comparison sample) | 42.0 quartz sand<br>25.0 cristobalite powder<br>9.1 magnesium oxide<br>8.0 phosphates<br>0.5 dyestuff<br>1.0 H-zeolite Y<br>14.4 quartz powder | 42.0 quartz sand<br>25.0 cristobalite powder<br>9.1 magnesium oxide<br>8.0 phosphates<br>0.5 dyestuff<br>0.5 citric acid<br>14.9 quartz powder (comparison sample) |
| Powder: Levotherm silica sol mixing fluid | 100 g: 16 ml | 100 g: 16 ml | 100 g: 16 ml |
| Process time (minutes) | 3.5 | 3.5 | 5.5 |
| Setting time (minutes) | 5.75 | 6.0 | 8.0 |
| Setting temperature (°C.) | 71.0 | 70.0 | 69.0 |
| Expansion on setting (%) | 0.2 | 0.2 | 0.7 |
| Compressive strength at room temperature ($N/mm^2$) | 14.7 | 17.5 | 10.2 |

The zeolite addition according to the invention does not cause any adverse influence on the compatibility with duplicating gel and on the expansion on setting. In addition, the mechanical properties have been improved due to the zeolithe addition.

We claim:

1. Casting phosphate-bonded investment compound powders, comprising, in addition to refractory materials and binders, zeolites in an amount of from 0.1 to 10% by total weight.

2. Casting phosphate-bonded investment compounds according to claim 1, wherein said zeolites are present in an amount of from 0.3 to 2.0% by total weight.

3. Casting phosphate-bonded investment compounds according to claim 1, wherein said zeolites are present in an amount of from 0.7 to 1.5% by total weight.

4. Casting phosphate-bonded investment compounds according to claim 1, wherein the zeolites represent one or more zeolites selected from the group consisting of faujasites, mordenites, zeolite β, zeolite Ω, zeolite L, zeolite A, offretite, ZSM 12, pentasils, PSH-3, ZSM 22, ZSM 23, ZSM 48, EU-1, zeolite T, chabasites, gmelinites, ferrierites, zeolite rho and ZK-5.

5. Casting phosphate-bonded investment compounds according to claim 1 wherein said zeolite is one or more acidic types of faujasite structure.

6. Casting investment compounds according to claim 1 in the form of a powder mixture.

7. Casting investment compounds according to claim 1, in the form of a mixture obtained by dough-forming with a suitable aqueous or alcoholic mixing fluid.

8. Investment compound models, made from casting phosphate-bonded investment compounds according to claim 1.

* * * * *